United States Patent [19]

Gevas

[11] 4,106,402

[45] Aug. 15, 1978

[54] EGG SHELL BREAKER

[76] Inventor: James Constantine Gevas, One Ford La., Roseland, N.J. 07068

[21] Appl. No.: 745,413

[22] Filed: Nov. 26, 1976

[51] Int. Cl.[2] ..... A47J 43/00

[52] U.S. Cl. ..... 99/571; 30/120.1; 99/582

[58] Field of Search ..... 99/568, 571, 582; 30/120.1

[56] References Cited

U.S. PATENT DOCUMENTS

| | | | |
|---|---|---|---|
| 1,491,908 | 4/1924 | Greig | 99/568 X |
| 2,457,912 | 1/1949 | Murray | 99/582 X |
| 2,525,923 | 10/1950 | Marceca | 30/120.1 |
| 2,798,521 | 7/1957 | Bourque | 30/120.1 |
| 2,962,067 | 11/1960 | Mesojedec | 99/568 X |
| 3,090,413 | 5/1963 | Rossi | 30/120.1 |
| 3,605,833 | 9/1971 | Strang | 99/571 X |
| 3,721,180 | 3/1973 | Strang | 99/571 |

FOREIGN PATENT DOCUMENTS

| | | | |
|---|---|---|---|
| 1,114,620 | 4/1956 | France | 99/582 |

*Primary Examiner*—Edward L. Roberts
*Attorney, Agent, or Firm*—Watson, Leavenworth, Kelton & Taggart

[57] ABSTRACT

A cylindrical tool with a breaking edge at one end, when disposed over and about an end of an egg, upon being struck, penetrates the shell to sever an end segment therefrom. The breaking edge is at the end of a thin member having a wall thickness of the same order of magnitude as the thickness of the egg shell, a double beveled end, and a reinforced body. The tool may be separately contained with its own handle or may be integrated in a separable base of an egg cup. The egg cup bowl may be elastic or otherwise provided with means for cushioning the egg. The breaking edge may be continuous, serrated, crenellated or otherwise configured.

12 Claims, 7 Drawing Figures

EGG SHELL BREAKER

DISCLOSURE

The present invention relates to a tool for breaking the shell of an egg and, more particularly, to a tool for facilitating access to the contents of a raw or cooked egg.

Particularly with soft boiled eggs and less frequently with hard boiled eggs, there is a need for creating an opening in the shell to permit the introduction of a spoon or other utensil for removing the contents. There are scissorlike instruments for removing the tops of hard boiled eggs which may be used on soft boiled eggs, although in the latter case it is not always possible to avoid contaminating the contents with shell fragments.

An object of the present invention is to provide a simple tool, which does not require particular skill to apply, for breaking the shell of an egg and severing an end segment therefrom of sufficient size to permit the introduction of a spoon, generally a teaspoon, through the resulting opening.

In accordance with the present invention there is provided such a tool comprising a hollow cylindrical body with a shell engaging edge at one end for disposition over and about an end of the egg shell with said edge engaging said egg shell along a circular line of contact lying intermediate the equator and a pole. The body has a circumferential section immediately adjacent said edge which section has a wall with substantially right circular cylindrical radially inner and outer surfaces and a thickness throughout its length of the same order of magnitude as the thickness of the egg shell. Means are provided strengthening said section to resist departure from circularity, and means are also provided for permitting the transfer of kinetic energy to said tool body generally in a direction parallel to the axis of said body for advancing said body axially through the egg shell severing said segment from the remainder of the shell for easy removal from said shell remainder.

The invention will be better understood after reading the following detailed description of the presently preferred embodiments thereof with reference to the appended drawings in which.

Figure 1:
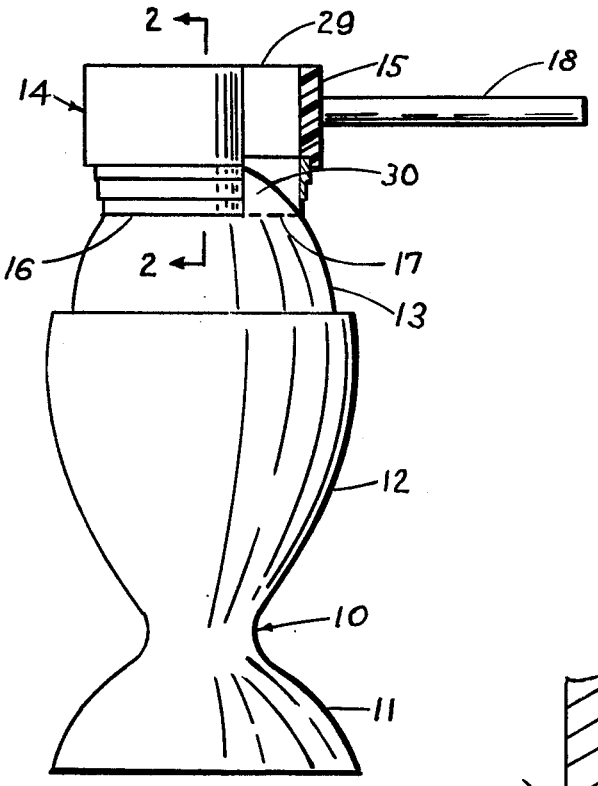
FIG. 1 is an elevational view showing an egg supported in an egg cup with one embodiment of the tool engaging the upper end of the shell prior to breaking same.

Referring now to the drawings, wherein the same reference numerals are used throughout the several figures to designate the same or similar parts, there is shown in FIG. 1 a conventional egg cup 10 having a base 11 and a bowl 12. An egg 13 is shown supported in the usual manner in the bowl 12.

The shell breaking tool of the present invention is shown generally at 14 having a hollow cylindrical body 15 with a shell engaging edge at one end 16. The tool 14 is shown disposed over and about an end of the shell of the egg 13 with the end 16 of the tool engaging the shell along a circular line of contact 17 lying intermediate the equator and a pole. The body 15 of the tool resembles a hollow round plinth and, in the embodiment being described, is open at both ends. The body also is provided with a handle 18 projecting therefrom as illustrated.

Figure 2:
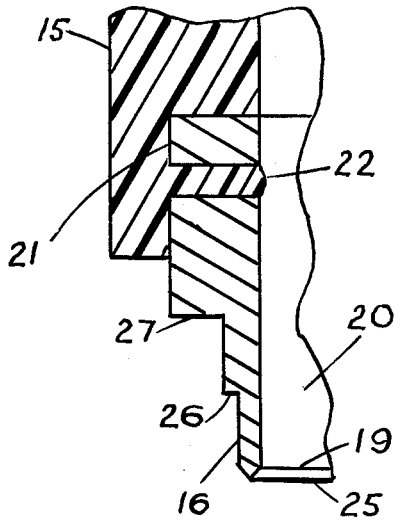
FIG. 2 is a fragmentary sectional view taken along line 2—2 of FIG. 1 and drawn to an enlarged scale for clarification.

A convenient method of fabricating the tool 14 is to mold the body 15 and handle 18 as an integral unit from a non-metallic material such as plastic with the breaking edge 19 located at the exposed end 16 (see FIG. 2) of a metallic cylindrical member 20 whose other end 21 is joined coaxially to one end of the non-metallic body 15. A series of apertures 22, only one of which is visible in FIG. 2, may be disposed circumferentially spaced around the circumference of the end 21 of the cylinder 20 for inter-engagement with the material of the body 15 to ensure interconnection therebetween.

Figure 3:
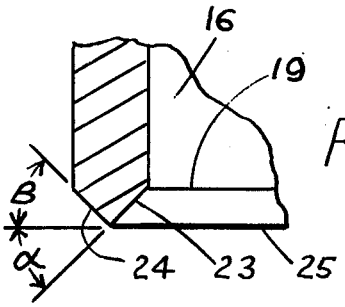
FIG.3 is a still further enlarged view of a fragment of the part of the tool shown in FIG. 2 showing details of the egg engaging edge thereof.

As best seen in FIG. 3, the exposed end 16 of the metallic member 20 is beveled in both directions at 23 and 24 with an additional edge 25 being formed at the intersection of the beveled surfaces 23 and 24. As shown in FIG. 3, the bevel angles of surfaces 23 and 24 are represented, respectively, by $\alpha$ and $\beta$ which, in the preferred embodiment, are equal and equal to 45°. However, as will be apparent from the ensuing discussion, such angles may be varied.

Referring again to FIG. 2, the wall thickness of the body of the tool 14 adjacent the end 16 is preferably about 0.006 inches, the same order of magnitude as the thickness of an egg shell. The axial length of the section from the edge 25 to the first shoulder 26 is about $\frac{1}{8}$ inch, at which point the outside diameter of the element 20 increases to a wall thickness of about 0.012 inches for a further distance of about $\frac{1}{8}$ inch to the second shoulder 27. At the shoulder 27 the outside diameter increases further to a wall thickness of about 0.080 inches. Stress relieving radii can be included to break the inside corners between the walls of the tool and the shoulders 26 and 27 if desired.

The internal diameter of the cylindrical member 20 preferably lies within the range of about 1.000 inch to 1.600 inches, although, a diameter of about 1.350 inches is presently deemed optimum.

When the tool 14 is applied to the shell of an egg 13 as shown in FIG. 1, the line of contact between the shell and the tool usually occurs along the edge 19 as seen in FIG. 3 due to the fact that, except for extremely large eggs, the slope of the shell at this point is greater than 45°. That is, it is greater than 45° when the tool has its optimum diameter of 1.350 inches as mentioned above and is applied to the usual range of egg sizes. When the tool has its minimum diameter or the egg is very large, contact between the tool and the shell may occur along the edge 25. However, in view of the thinness of the end 16 of the tool, it has been found that the tool will function substantially equally well regardless of whether edge 19 or 25 first engages the shell.

It is important that the cylindrical member 20 be so reinforced and hardened that the end 16 resists deformation or departure from circularity as the tool is urged axially against the end of the shell during an opening operation. In use, with the tool in place as shown in FIG. 1, the upper edge 29 may be struck with the back of a spoon or the handle of a knife or the like to impart kinetic energy to the body 15 generally in a direction parallel to the axis of the body for advancing the latter axially through the shell severing the segment around the line 17 from the remainder of the shell and enabling such segment, the crown 30, to be removed easily from the remainder of the shell after the body 15 has been removed. Occasionally, the separated segment lodges within the body 15 and is removed therewith when the tool is extracted.

Figure 4:
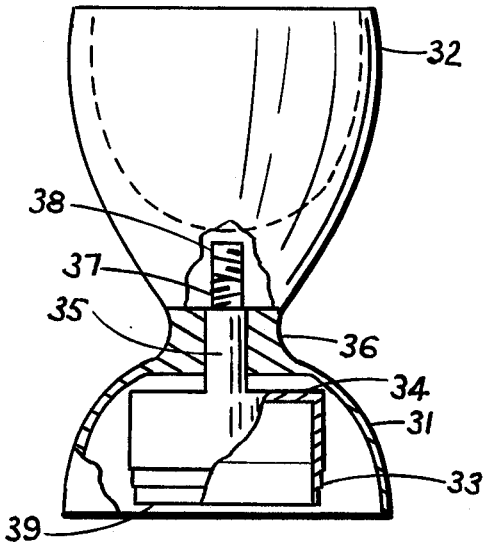
FIG. 4 is an elevational view partially broken away showing a modified egg cup incorporating an egg shell breaking tool in accordance with the present invention.
Figure 5:
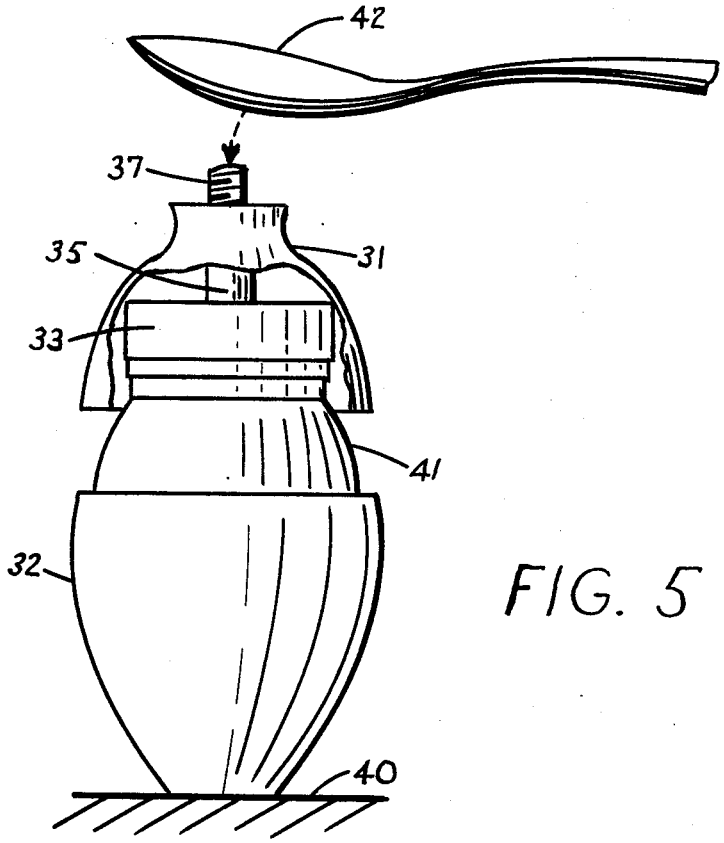
FIG. 5 is an elevational view showing the cup of FIG. 4 in use with the base member which contains the tool separated from the bowl which holds an egg and with the tool in position on the top of the egg for acting thereupon.

Referring now to FIGS. 4 and 5 there is illustrated a different embodiment of the invention wherein the tool is integrated into the base 31 of an egg cup having a bowl 32. The body of the tool, 33, is cup shaped with an end closure member 34 secured to the end of a post 35 molded into the waist region 36 of the base 31. As seen in FIG. 5, the upper end of the post 35 is threaded at 37 and projects from the base 31. The threaded end 37 of the post enables the base 31 to be threadedly engaged in a threaded socket 38 in the bottom of the bowl 32. The operative end 39 of the tool body 33 may have the same construction as the operative end of the tool 14 shown in FIGS. 1, 2 and 3.

As seen in FIG. 5, the base 31 has been separated from the egg cup bowl 32 which latter has been positioned on a horizontal surface, e.g., a table 40, with an egg 41 disposed therein. The base 31 is shown surmounting the egg 41 with the tool 33 resting on the top of the shell. A spoon 42 is shown about to strike the threaded end 37 of the post 35 which functions as an impact target for transferring kinetic energy to the tool 33. The function of the tool is otherwise similar to that described with reference to FIGS. 1, 2 and 3.

Figure 6:
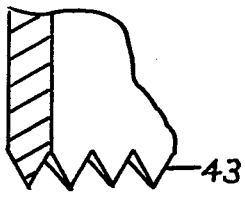
FIG. 6 is a view similar to FIG. 3 showing a modification thereof.
Figure 7:
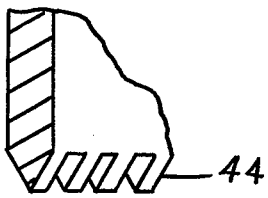
FIG. 7 is a view similar to FIG. 6 showing a still further modification thereof.

The edge of the working end 16 of the tool may be continuous as shown in FIGS. 1 through 5 or may be serrated as shown at 43 in FIG. 6 or crenellated as shown at 44 in FIG. 7. Other edge configurations may also be useful.

As an adjunct to the breaking tool, it will be found helpful if the egg cup or other receptacle for the egg for holding the same during the end breaking operation is provided with means for cushioning the egg as the tool is applied to the shell. For example, the bowl of the egg cup can be formed from a resilient or elastomeric material so that it conforms readily to the configuration of the egg shell and thereby avoids applying localized pressure to isolated points on the shell. Alternatively, a ceramic or other type of rigid egg cup can be utilized with an expanded foam lining or the like in order to afford the necessary cushioning. Of course, if the bowl of the egg cup is suitably configured and dimensioned, cushioning may not be necessary, particularly if appropriate care is taken in avoiding excessive force when striking the breaking tool.

While the lower edge of the breaking tool has been shown beveled in the various figures of the drawings, acceptable results have been obtained with the lower end 16 either partially or completely squared off rather than beveled. However, it is believed that the beveling produces somewhat better results with less fragmentation of the adjacent shell area when the tool is applied.

A modified version of the tool was tried wherein the bevel angle $\alpha$ was 90° and the angle $\beta$ was approximately 60°. While this embodiment appeared to work satisfactorily, there was a risk of injury to the fingers because of the extremely sharp edge at the operative end. Surprisingly, the double beveled arrangement of FIG. 3 has been found to work as well if not better than the single beveled embodiment.

Having described the presently preferred embodiments of the subject invention, it will be understood that various changes in the details of construction may be introduced by those skilled in the art without departing from the true spirit of the invention as defined in the appended claims.

What is claimed is:

1. A tool for breaking the shell of an egg and severing an end segment therefrom comprising a hollow cylindrical body with a shell engaging edge at one end for disposition over and about an end of said shell with said edge engaging said shell along a circular line of contact lying intermediate the equator and a pole, said body having a circumferential section immediately adjacent said edge which section has a wall with substantially right circular cylindrical radially inner and outer surfaces and a thickness throughout its length of the same order of magnitude as the thickness of said shell, means strengthening said section to resist departure from circularity when advanced through said shell, and means for permitting the transfer of kinetic energy to said body generally in a direction parallel to the axis of said body for advancing said body axially through said shell severing said segment from the remainder of the shell for easy removal from said shell remainder.

2. A tool according to claim 1, wherein said body is formed from hardened metal and reinforced with a stepped wall to resist departure from circularity.

3. A tool according to claim 1, wherein said body resembles a hollow round plinth, open at both ends, provided with a handle projecting therefrom.

4. A tool according to claim 3, wherein said body and said handle are formed from non-metallic material and said shell engaging edge is located at the exposed end of a metallic cylindrical member whose other end is joined coaxially to one end of said body.

5. A tool according to claim 4, wherein said metallic cylindrical member is reinforced with a stepped wall and hardened to resist said departure from circularity and has an internal diameter within the range of 1.000 to 1.600 inches.

6. A tool according to claim 4, wherein said metallic member has a wall thickness at said exposed end of about 0.006 inch for an axial distance of about $\frac{1}{8}$ inch constituting said circumferential section, followed by an external increase in diameter to a wall thickness of about 0.012 inch for a further distance of about $\frac{1}{8}$ inch followed by a still further external diameter increase to a wall thickness of about 0.080 inch.

7. A tool according to claim 6, wherein said metallic member at said exposed end is beveled in both directions at about 45° with an additional edge being formed at the intersection of the beveled surfaces.

8. A tool according to claim 1, wherein said body is cup shaped and secured within the bottom of an egg cup and removable with said bottom from the bowl of the cup for application to an egg shell, and said bowl of said cup includes means for cushioning the egg as the tool is applied to the shell.

9. A tool according to claim 1, wherein said one end of said body is beveled in both directions at about 45° with an additional edge being formed at the intersection of the beveled surfaces, and said shell engaging edge is at the intersection of the internal one of said beveled surfaces and the internal surface of said body.

10. A tool according to claim 1, wherein said circumferential section has a wall thickness of about 0.006 inch.

11. A tool according to claim 10, wherein said circumferential section is about $\frac{1}{8}$ inch long, followed by an external increase in diameter to a wall thickness of about 0.012 inch for a further distance of about $\frac{1}{8}$ inch followed by a still further external diameter increase to a wall thickness of about 0.080 inch.

12. A tool according to claim 11, wherein the exposed end of said circumferential section is beveled in both directions at about 45° with an additional edge being formed at the intersection of the beveled surface.

* * * * *